US006824452B1

(12) United States Patent
Hung et al.

(10) Patent No.: US 6,824,452 B1
(45) Date of Patent: Nov. 30, 2004

(54) POLISHING PAD AND PROCESS OF CHEMICAL MECHANICAL USE THEREOF

(75) Inventors: Yung-Tai Hung, Chiayi (TW); Yuhturng Liu, Kaohsiung (TW); Hsueh-Hao Shih, Hsinchu (TW); Kuang-Chao Chen, Hsinchu (TW)

(73) Assignee: Macronix International Co., Ltd., Hsinchu (TW)

( * ) Notice: Subject to any disclaimer, the term of this patent is extended or adjusted under 35 U.S.C. 154(b) by 0 days.

(21) Appl. No.: 10/605,425

(22) Filed: Sep. 30, 2003

(30) Foreign Application Priority Data

Jun. 18, 2003 (TW) ..... 92116501 A

(51) Int. Cl.[7] ..... B24B 1/00

(52) U.S. Cl. ..... 451/57; 451/28; 451/41; 451/285; 451/286; 451/526; 451/528; 451/532; 451/539

(58) Field of Search ..... 451/28, 41, 57, 451/285, 286, 287, 526, 528, 532, 539

(56) References Cited

U.S. PATENT DOCUMENTS 6,062,968 A * 5/2000 Sevilla et al. ..... 451/526
6,431,959 B1 * 8/2002 Mikhaylich et al. ..... 451/41

* cited by examiner

*Primary Examiner*—Joseph J. Hail, III
*Assistant Examiner*—Shantese McDonald
(74) *Attorney, Agent, or Firm*—Jianq Chyun IP Office

(57) ABSTRACT

A chemical mechanical polishing to polish a substrate having a layer to be polished thereon is described. A pre-polishing process is performed using a softer polishing pad to remove partially raised parts of the layer to be polished before conducting a polishing process using a harder polishing pad. Since the first polishing pad is flexible, porous and with low density, the first polishing pad can be deformed to increase contact areas between the first polishing pad and the raised part of the layer to be polished, and the abrasives are embedded easily in holes of the surface of the first polishing pad. Ultimately, the layer to be polished can be polished directly during the pre-polishing process. Therefore, the processing time is reduced, the consumption of the slurry is decreased and the process cost can be cut down substantially.

16 Claims, 2 Drawing Sheets

POLISHING PAD AND PROCESS OF CHEMICAL MECHANICAL USE THEREOF

CROSS REFERENCE TO RELATED APPLICATIONS

This application claims the priority benefit of Taiwan application Ser. No. 92116501, filed on Jun. 18, 2003.

BACKGROUND OF INVENTION

1. Field of Invention

The present invention relates to a polishing pad and a process of chemical mechanical polishing use thereof. More particularly, the present invention relates to a polishing pad and a process of chemical mechanical polishing use thereof to cut down the processing time and cost.

2. Description of Related Art

Due to market demand, the development trend of semiconductors is towards smaller-scale. The exposure resolution must be improved to meet the requirements of fabricating small-scale semiconductors. A light with shortened wavelength serving as the light source is a means of improving the exposure resolution, but this means leads to shallow depth of focus. Accordingly, the level of the topographic surface of the wafer must be further planarized to solve the problem of shallow depth of focus. Chemical mechanical polishing (CMP) is the most important planarization technique, because it provides a global planarization of the wafer surface. Chemical mechanical polishing process can be used, for example, for forming a shallow trench isolation, a dual damascene structure, a micro-electromechanical system or a panel display.

In the process of fabricating a shallow trench isolation, a chemical mechanical polishing process is performed to polish the silicon oxide layer filled into a trench. However, in case the pattern density of the silicon oxide layer is non-uniform, the polishing rate of the regions with a high density pattern is faster than the polishing rate of the regions with a low density pattern. In addition, the polishing selectivity of silicon oxide to silicon nitride mask layer is low when the slurry abrasive is silica, which is generally used in the polishing process. Accordingly, the silicon oxide layer and the silicon nitride mask layer in the regions with a high density pattern are over polished, leading to a dishing effect. Hence, the uniformity of the device is seriously affected. In order to prevent this problem, a photolithographic process using a reverse-tone mask and an etching process are preformed for patterning the silicon oxide layer to uniform pattern density before the silicon oxide layer is polished. However, an additional mask, an additional photographic process and an additional etching process are required, so that the fabricating process become complicated and the cost is increased.

Currently, a new slurry is used for polishing the filled silicon oxide in the shallow trench isolation, wherein the slurry mainly includes abrasives made of $CeO_2$. Using this slurry, the polishing selectivity of silicon oxide to silicon nitride is very high, so that the mask layer made of silicon nitride can avoid the over removing problem even without performing the additional photolithographic process using the reverse-tone mask and the additional etching process.

However, some problems exist in the chemical mechanical polishing process using the slurry including $CeO_2$ abrasive, which are as follows. FIGS. 1A to 1C are schematic, cross-sectional views, illustrating the chemical mechanical polishing process using the $CeO_2$ slurry according to the prior art. Referring to FIG. 1A, a substrate 100 is provided, wherein the substrate 100 has a layer to be polished 102 having an uneven topographic surface formed thereon. A surface of the substrate 100, with the layer to be polished 102 formed thereon, is placed facing the polishing pad 110 on a polishing machine, simultaneously, slurry with the $CeO_2$ abrasives 120 is supplied to the polishing pad 110.

Thereafter, referring to FIG. 1B, a polishing process is performed. First, the $CeO_2$ abrasive 120 is filled in the gap between raised parts of the layer to be polished 102. Thereafter, polishing of the layer 102 begins after the gap is filled with the $CeO_2$ abrasives 102 as shown in FIG. 1C.

In other words, the step of filling the $CeO_2$ abrasive 120 in the gap and the step of polishing the layer 102 are not performed simultaneously. A polishing effect is produced after the gap is filled with the $CeO_2$ abrasives 120, but no effective polishing occurs during the filling of the $CeO_2$ abrasive 102 into the gap.

The step of filling the $CeO_2$ abrasive 102 into the gap consumes a long time before the polishing process is performed; and consequently, time cost and process cost are very high.

SUMMARY OF INVENTION

The invention provides a chemical mechanical polishing process to decrease the consumption of abrasives of a slurry.

The invention provides a chemical mechanical polishing process to cut down the process cost and decrease the processing time.

The invention provides a chemical mechanical polishing process to prevent dishing effect.

The present invention provides a chemical mechanical polishing to a substrate having a layer thereon. A pre-polishing process is performed to partially remove raised parts of the layer before conducting a polishing process. Physical properties of the first polishing pad used in the pre-polishing process are different from those of the second polishing pad using in the polishing process and the first polishing pad is not a nonwoven fabric layer. Comparing to the second polishing pad, the first polishing pas has a lower hardness, a lower density, a higher porosity and a rougher surface roughness.

According to an embodiment of this invention, the first polishing pad has the following properties: i. a hardness of 30–35 Shore D; ii. a density of 0.30–0.40 g/cm$^3$; iii. a compressibility of 2.0–3.0%; and iv. a rebound of 70–100%.

The second polishing pad has the following properties: i. a hardness of 50–65 Shore D; ii. a density of 0.60–0.80 g/cm$^3$; iii. a compressibility of 2.0–3.0%; and iv. a rebound of 70–100%.

The slurry abrasive material used in the pre-polishing process and the polishing process includes $CeO_2$. In addition, the first polishing pad and the second polishing pad of this invention can be integrated into a polishing pad having two regions. The first region of the two regions, which is formed of a soft material, is used in the first stage chemical mechanical polishing process, and the second region of the two regions, which is formed of hard material, is used in the second stage chemical mechanical polishing process.

The present invention further provides a planarization process of a semiconductor device to polish a substrate having a layer to be polished thereon. First, slurry is applied to a first polishing pad and the substrate is arranged on the first polishing pad, wherein a material of the first polishing pad is flexible. A first stage polishing process is performed to remove raised parts of the layer to be polished. Thereafter, a second slurry is applied to a second polishing pad and the substrate is placed on the second polishing pad, wherein the first polishing pad is softer than the second polishing pad. A second stage polishing process is conducted to further planarize the layer to be polished.

In the present invention, since the first polishing pad is flexible, porous and with low density, the first polishing pad can be deformed to increase contact areas between the first polishing pad and the raised part of the layer to be polished, and the abrasives easily fill into holes of the surface of the first polishing pad. Ultimately, the layer to be polished can be polished directly during the first stage polishing process, and the time spent waiting for abrasives to fill into the gaps between the raised parts can be saved. Moreover, the consumption of the slurry can be decreased. The slurry abrasives are very expensive, therefore, the process cost can be cut down substantially.

In addition, $CeO_2$ slurry abrasives can be used with this invention used for polishing a silicon oxide layer of a shallow trench isolation fabrication. Using the slurry, the polishing selectivity of silicon oxide to silicon nitride is very high, so that the dishing effect still can be avoided without performing the additional photolithographic process using the reverse-tone mask and the additional etching process.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

The present invention provides a chemical mechanical polishing process, which can be used in the planarization process of fabricating a variety of semiconductor devices, such as a shallow trench isolation process. However, this invention can also be used in the planarization process of other different structures without departing from the scope or spirit of the invention.

Figure 1A:
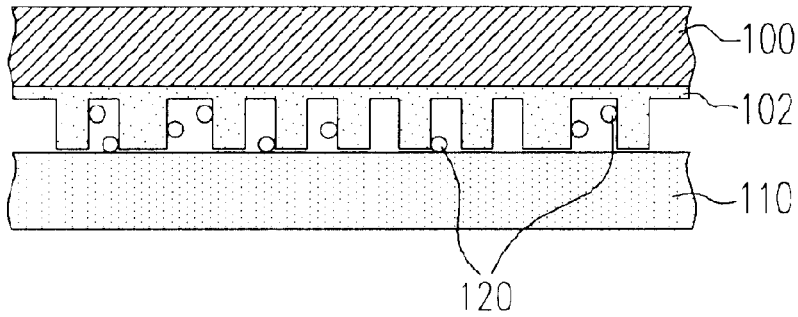
FIG. 1A(PRIOR ART)
FIGS. 1A to 1C are schematic, cross-sectional views, illustrating the chemical mechanical polishing process using a slurry including $CeO_2$ abrasives according to the prior art.
Figure 1B:
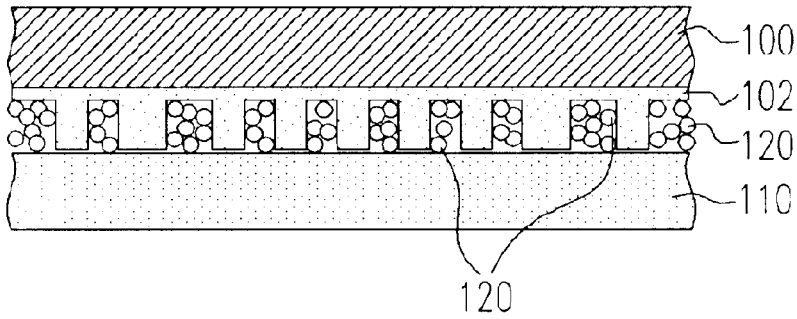
FIG. 1B(PRIOR ART)
Figure 1C:
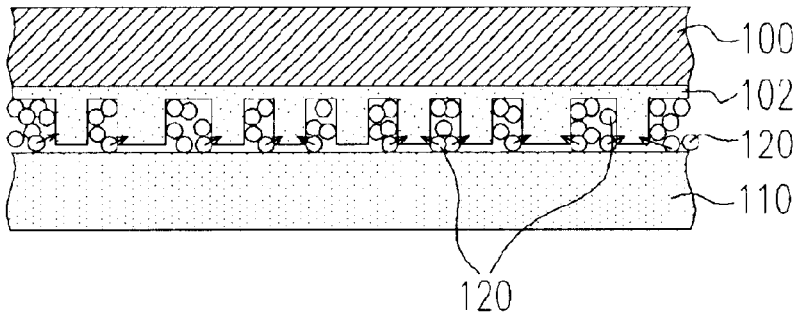
FIG. 1C(PRIOR ART)
Figure 2A:
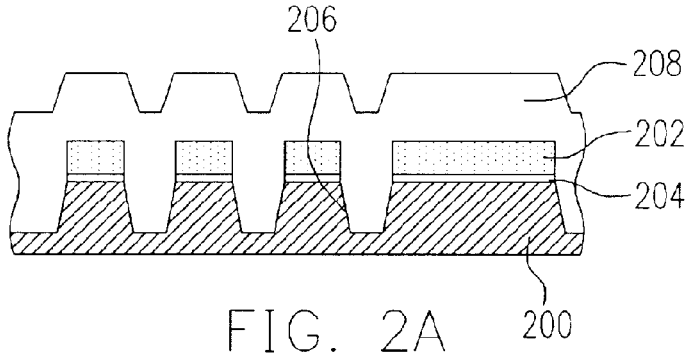
FIGS. 2A to 2C are schematic, cross-sectional views, illustrating the planarization of a semiconductor device using a chemical mechanical polishing process according to an embodiment of the present invention.
Figure 2B:
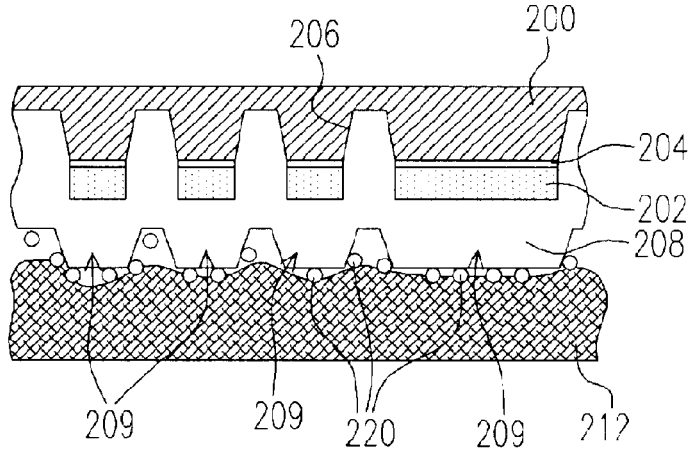
Figure 2C:
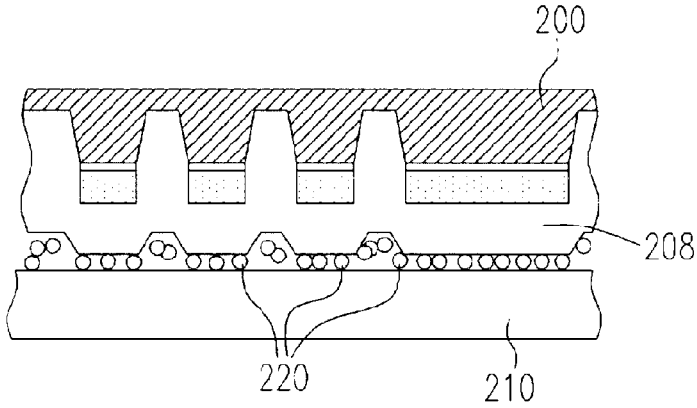

FIGS. 2A to 2C are schematic and cross-sectional views, illustrating the planarization of a semiconductor device using a chemical mechanical polishing process according to an embodiment of the present invention. This embodiment illustrates a process of fabricating a shallow trench isolation.

Referring to FIG. 2A, a substrate 200 is provided, wherein the substrate 200 has a silicon oxide layer 204 thereon and a silicon nitride layer 202 on the silicon oxide layer 204. In addition, the substrate 200 has trenches 206 therein. The trenches 206 are formed by, for example, a photographic process and an etching process to pattern the silicon nitride layer 202 and silicon oxide layer 204, and then continuing etching the substrate 200. Moreover, a silicon oxide layer 208, which is the layer to be polished is formed over the substrate 200, filling the trenches 206 and covering the silicon nitride layer 202. The silicon oxide layer 208 is, for example, a high density plasma (HDP) silicon oxide layer, a borophosphosilicate glass (BPSG) layer, phosphosilicate glass (PSG), a tetraethyl-ortho-silicate (TEOS) silicon oxide layer or other insulating layers.

Referring to FIG. 2B, a surface of the substrate 200, where the silicon oxide layer 208, i.e. the layer to be polished, is placed facing a soft polishing pad 212 on a polishing machine. Simultaneously, slurry with abrasive 220 is supplied to the soft polishing pad 212, wherein abrasive 220 is formed of $CeO_2$, for example. The material of the soft polishing pad 212 is a flexible and deformable material and is not nonwoven fabric. The preferred material of the soft polishing pad 212 comprises at lest one moiety from the group consisting of urethane, an amide, a carbonate, an ester; an ether, an acrylate; methacrylate; an acrylic acid; a methacrylic acid, a sulphone, an acrylamide, a halide; an imide; a carboxyl; a carbonyl; an amino, an aldehydric; a urea and a hydroxyl. The preferred soft polishing pad 212 has the following properties: i. a hardness of 30–35 Shore D; ii. a density of 0.30–0.40 g/cm$^3$; iii. iii. a compressibility of 2.0–3.0%; and iv. a rebound of 70–100%.

Compared with the conventional polishing pad, the density of the soft polishing pad 212 of this invention is lower and the porosity of the soft polishing pad of this invention is higher. Furthermore, the surface roughness of the soft polishing pad 212 is rougher. Thereafter, a first stage chemical mechanical polishing process, i.e., a pre-polishing process using the soft polishing pad, is performed until the thickness of the raised parts 209 is decreased substantially. Therefore, the depth of the gaps between the raised parts 209 is decreased substantially. When the raised parts 209 of the silicon oxide layer 208 contact with the soft polishing pad 212, the soft polishing pad 212 is deformed to increase the contact area between raised parts 209 of the silicon oxide layer 208 and the soft polishing pad 212 as shown in FIG. 2B. In addition, since the porosity of the soft polishing pad is higher than that of the prior art, the abrasive is easily filled into holes of the surface of the soft polishing pad 212. Therefore, the raised parts 209 of the silicon oxide layer 208 begin to be polishing without the gaps of the silicon oxide layer 208 being completely filled with the abrasive 220.

Referring to FIG. 2C, after the raised parts 209 of the silicon oxide layer 208 have been polished substantially using the soft polishing pad 212, a second stage chemical mechanical polishing process is performed. In the second stage chemical mechanical polishing process, a hard polishing pad 210 is used in place of the soft polishing pad 212. Simultaneously, slurry with abrasive 220 is supplied to the soft polishing pad 212, wherein abrasive 220, for example, is formed of $CeO_2$. The preferred material of the hard polishing pad 210 comprises at lest one moiety from the group consisting of urethane, an amide, a carbonate, an ester; an ether, an acrylate; methacrylate; an acrylic acid; a methacrylic acid, a sulphone, an acrylamide, a halide; an imide; a carboxyl; a carbonyl; an amino, an aldehydric; a urea and a hydroxyl. The preferred hard polishing pad 210 has the following properties: i. a hardness of 50–65 Shore D; ii. a density of 0.60–0.80 g/cm$^3$; iii. a compressibility of 2.0–3.0%; and iv. a rebound of 70–100%.

Compared with the soft polishing pad 212, the density of the hard polishing pad 210 is higher and the porosity of the hard polishing pad 210 is lower. Furthermore, the surface roughness of the hard polishing pad 210 is smoother than the soft polishing pad 212. Since the raised parts 209 of the silicon oxide layer 208 have been substantially polished in the first chemical mechanical polishing process, the thickness of the raised parts 209 is decreased substantially, i.e., the gaps between the raised parts 209 become very shallow. Consequently, at the same time the abrasive 220 is filled into the gaps, it also acts on the remained silicon oxide layer 208. In other words, the remained silicon oxide layer 208 is polished directly as soon as the second stage chemical mechanical polishing process is performed. In addition, in the second stage chemical mechanical polishing process, a $CeO_2$ slurry having a high selectivity of silicon nitride to silicon oxide can be selected. Therefore, the planarizition of the surface of the substrate is uniform after conducting the second stage chemical mechanical polishing process.

On the other hand, the soft polishing pad and the hard polishing pad of this invention can be combined in a polishing pad. The polishing pad comprises two regions: one is the first region that is formed by a soft material used in the first stage chemical mechanical polishing process, and the other is the second region that is formed by a hard material used in the second stage chemical mechanical polishing process.

According to the chemical mechanical polishing process provided by the preferred embodiment of the present invention, the pre-polishing process is performed to substantially remove the raised parts of the layer to be polished before conducting the polishing process. The first polish pad using in the pre-polishing process is different from the second polishing pad using in the polish process. The former is softer than that of the latter, the density of the former is lower than that of the latter and the porosity of the former is higher than that of the latter. Since the first polishing pad is flexible, porous and with low density, the first polishing pad can be deformed to increase contact areas between the first polishing pad and the raised part of the layer to be polished, and the abrasives easily filled into holes of the surface of the first polishing pad. Ultimately, the layer to be polished can be polished directly during the first stage, and the time spent waiting for abrasives to fill into the gap between the raised part can be saved. Moreover, the consumption of the slurry can be decreased. The slurry abrasives are very expensive; therefore, the process cost can be cut down substantially.

In addition, the $CeO_2$ slurry abrasive can be used when this invention is used for forming a shallow trench isolation. Using the slurry, the polishing selectivity of silicon oxide to silicon nitride is very high, so that the dishing effect can be avoided without performing the additional photolithographic process using the reverse-tone mask and the additional etching process.

It will be apparent to those skilled in the art that various modifications and variations can be made to the process of the present invention without departing from the scope of the spirit of the invention. In view of the foregoing, it is intended that the present invention cover modifications and variations of this invention provided they fall within the scope of the following claims and their equivalents.

What is claimed is:

1. A chemical mechanical polishing process, comprising:

providing a substrate, wherein a layer to be polished having raised parts is formed thereon;

performing a first stage chemical mechanical polishing process using a soft polishing pad to substantially remove the raised parts of the layer to be polished, wherein the soft polishing pad is not a nonwoven fabric layer; and performing a second stage chemical mechanical polishing process using a hard polishing pad to polish the remained layer, wherein physical properties of the soft polishing pad are different from those of the hard polishing pad.

2. The process of claim 1, wherein the surface roughness of the soft polishing pad is rougher than the hard polishing pad.

3. The process of claim 1, wherein a porosity of the soft polishing pad is higher than that of the hard polishing pad.

4. The process of claim 1, wherein a density of the soft polishing pad is lower than that of the hard polishing pad.

5. The process of claim 1, wherein a hardness of the soft polishing pad is lower than that of the hard polishing pad.

6. The process of claim 1, wherein the soft polishing pad has the following properties:

i. a hardness of 30–35 Shore D;

iia density of 0.30–0.40 g/cm$^3$;

iii. a compressibility of 2.0–3.0%; and iv. a rebound of 70–100%.

7. The process of claim 1, wherein the hard polishing pad has the following properties:

i. a hardness of 50–65 Shore D;

iia density of 0.60–0.80 g/cm$^3$;

iii. a compressibility of 2.0–3.0%; and i. a rebound of 70–100%.

8. The process of claim 7, wherein the hard polishing pad comprises at lest one moiety from the group consisting of urethane, an amide, a carbonate, an ester; an ether, an acrylate; methacrylate; an acrylic acid; a methacrylic acid, a sulphone, an acrylamide, a halide; an imide; a carboxyl; a carbonyl; an amino, an aldehydric; a urea and a hydroxyl.

9. The process of claim 1, wherein the soft polishing pad and the hard polishing pad are combined in a polishing pad, the soft polishing pad is on a first region of the polishing pad and the hard polishing pad is on a second region of the polishing pad.

10. The process of claim 1, wherein the first stage chemical mechanical polishing process comprises using a slurry including $CeO_2$ abrasive.

11. The process of claim 1, wherein the second stage chemical mechanical polishing process comprises using a slurry including $CeO_2$ abrasive.

12. The process of claim 1, wherein the layer to be polished is a silicon oxide layer.

13. The process of claim 12, wherein a material of the silicon oxide layer comprises high density plasma silicon oxide.

14. The process of claim 12, wherein a material of the silicon oxide layer comprises borophosphosilicate glass (BPSG).

15. The process of claim 12, wherein a material of the silicon oxide layer comprises tetra-ethyl-ortho-silicate silicon oxide.

16. A polishing pad, having the following properties:

i. a hardness of 30–35 Shore D;

ii. a density of 0.03–0.40 g/cm$^3$;

iii. a compressibility of 2.0–3.0%; and iv. a rebound of 70–100%.

* * * * *